United States Patent [19]

Scales

[11] 4,370,075

[45] Jan. 25, 1983

[54] REVETMENT GRIDS AND MATS

[75] Inventor: John M. Scales, Norcross, Ga.

[73] Assignee: Nicolon Corporation, Atlanta, Ga.

[21] Appl. No.: 201,569

[22] Filed: Oct. 28, 1980

[51] Int. Cl.[3] ..... F02B 3/12

[52] U.S. Cl. ..... 405/20; 52/596; 404/41

[58] Field of Search ..... 405/15, 16, 17, 19, 405/20, 29; 404/40–45; 52/596, 597

[56] References Cited

U.S. PATENT DOCUMENTS

| | | | |
|---|---|---|---|
| 392,277 | 11/1888 | Loy . | |
| 1,847,868 | 3/1932 | Everham . | |
| 2,159,685 | 5/1939 | Buzzel . | |
| 2,368,330 | 1/1945 | Schwartz | 404/41 |
| 2,454,292 | 11/1948 | Pickett . | |
| 2,502,757 | 4/1950 | Shearer . | |
| 2,674,856 | 4/1954 | Louckes . | |
| 2,876,628 | 3/1959 | Dixon . | |
| 3,096,621 | 7/1963 | Danel | 405/16 |
| 3,176,468 | 4/1965 | Nagai . | |
| 3,386,252 | 6/1968 | Nelson . | |
| 3,597,928 | 8/1971 | Pilaar . | |
| 3,894,397 | 7/1975 | Fair . | |
| 3,903,702 | 9/1975 | Appleton . | |
| 3,990,247 | 11/1976 | Palmer . | |
| 3,999,398 | 12/1976 | Kurose . | |
| 4,067,196 | 1/1978 | Schraudenbach . | |
| 4,227,829 | 10/1980 | Landry | 405/258 X |

FOREIGN PATENT DOCUMENTS

| | | | |
|---|---|---|---|
| 543799 | 1/1956 | Belgium | 404/41 |
| 1534425 | 6/1969 | Fed. Rep. of Germany | 404/41 |
| 1942406 | 8/1969 | Fed. Rep. of Germany . | |
| 2123523 | 11/1972 | Fed. Rep. of Germany . | |
| 2752545 | 11/1977 | Fed. Rep. of Germany . | |
| 728181 | 12/1931 | France . | |
| 453591 | 12/1949 | Italy | 404/41 |
| 869201 | 1/1957 | Netherlands . | |
| 659721 | 10/1951 | United Kingdom . | |
| 1166232 | 10/1969 | United Kingdom | 404/41 |

*Primary Examiner*—Dennis L. Taylor
*Attorney, Agent, or Firm*—Kilpatrick & Cody

[57] ABSTRACT

A cellular precast grid and mat for use as revetment. The grid, which may typically be cast of concrete, is substantially rectangular, having a flat bottom and, in its middle, two optional vertical openings of rectangular cross section with two inwardly sloping sides. The grid also has two vertical U-shaped channels on each longer opposed side and a two-tier vertical channel on each shorter opposed side, which vertical channel can accept projecting portions of the shorter side of two like grids positioned in abutting relationship, thereby permitting arrangement of grids into revetment of abutting staggered interlocking rows of grids. The grids may be individually placed with or without interconnecting pins or may be interconnected into mats by passing cables through tunnels passing horizontally through the grids parallel to the longer sides. Since such cables pass through staggered grids, parallel cables running in a single direction effectively interconnect grids into an integral mattress of staggered rows of grids to produce articulatable concrete mat revetment which may be used with or without filter means constructed of natural materials or filter fabric or other flexible liquid-permeable membrane.

14 Claims, 22 Drawing Figures

REVETMENT GRIDS AND MATS

BACKGROUND OF THE INVENTION

1. The Field of the Invention

This invention pertains to cellular precast blocks or grids for use with or without interconnecting cables as revetment for stabilization of the banks of streams and rivers, levies, river bottoms, shores, ditches, channels, canals and the like and protection from erosion by water waves and currents and/or wind.

2. Description of the Prior Art

The use of precast concrete members, including members joined into a mat or mattress by interconnecting cables or rods, is well known in the art. Such previously known members include precast concrete members with or without cellular structure and members cast around rods or cables utilized for interconnection of members into a mat as well as members cast with tunnels or openings through which connecting means, such as cables or rods, are passed to accomplish interconnection of members into mats.

Known flexible concrete revetment includes an articulated concrete mattress comprising rectangular slabs of concrete interconnected by wires as disclosed by U.S. Pat. Nos. 2,674,856 and 2,876,628. Such revetment permits considerable erosion when cracks appear in slabs and does not accommodate hydrostatic pressure. It also inhibits establishment of vegetative growth and does not encourage sedimentation or provide velocity dissipation of flowing water.

An improved flexible concrete revetment is disclosed by U.S. Pat. No. 3, 597,928, which comprises a flexible liquid-permeable supporting sheet upon which precast concrete blocks, which have vertical drainage openings, are secured in side by side abutting arrangement. In one form of this revetment, the top surface of the blocks has grooves which form castellations on such surface. The improved revetment of U.S. Pat. No. 3,597,928 avoids the erosion following cracking exhibited by earlier flexible concrete revetment, can accommodate hydrostatic pressure, encourage vegetative growth and sedimentation and provide velocity dissipation for flowing water. The revetment disclosed by U.S. Pat. No. 3,597,928, does not, however, provide the novel means for interlocking adjacent rows of grids provided by the present invention nor does it provide for interconnection of concrete grids into a mattress with pins or parallel cables running in a single direction. It further does not provide a highly articulatable mattress of the present invention while maintaining close abutting contact between adjacent grids in the mattress, nor does it provide other desirable features of the present invention more fully described below.

Desirable properties of revetment include provision of revetment members which mechanically interlock to create a highly stable revetment mat with or without use of additional connecting means, which mat can be interconnected with additional connecting means comprising pins or a single series of parallel cables or rods, can be simply and inexpensively manufactured, and will function as intended by resisting displacement of revetment members by hydraulic pressure, will dissipate water flow, retain particulate matter such as soil, backfill or silt deposits and support and encourage vegetative growth. Revetment exhibiting all of these properties has not heretofore been available.

It is therefore an object of the present invention to provide a cellular precast grid adapted for use as revetment, which interlocks with like grid members into a mat with or without utilization of separate connecting means.

It is a further object of the present invention to provide a cellular precast grid adapted for use as revetment which may be produced of concrete or of other moldable or castable materials.

It is a further object of the present invention to provide a revetment mat of interlocking cellular precast grids interconnected with a single series of parallel cables or rods passing through grid members.

It is a further object of the present invention to provide cellular precast grids and revetment mats which can be simply and inexpensively manufactured utilizing conventional precast concrete manufacturing techniques.

Further objects of the invention include provision of revetment grids and mats designed to resist displacement in use by hydraulic pressure while dissipating water flow and retaining particulate matter such as soil backfill or silt deposition.

A further object of the invention is provision of a grid and mat which will support and encourage vegetative growth.

A further object is provision of revetment grids and mats which exhibit a highly pedestrianable surface.

A further object is provision of a revetment mat which is highly articulatable and thus able to accommodate the topographic contours of sites where such mats are installed.

It is a further object of the present invention to provide a versatile cellular precast grid which may be interconnected with cables into revetment mats in a variety of configurations.

It is a further object of the present invention to provide a revetment mat which utilizes a minimum quantity of interconnecting cable.

It is a further object of the present invention to provide a cellular precast grid design which avoids the tendency for defects to occur in the grid during its manufacture.

It is a further object of the present invention to provide cellular precast grids and revetment mats which may be used with or without filter fabric or other flexible liquid-permeable membranes.

It is a further object of the present invention to provide revetment mats which may be interconnected with like mats to provide continous revetment of any desired dimensions.

It is a further object to provide revetment with a low Manning coefficient.

It is a further object of the present invention to provide revetment which facilitates drainage of water through such revetment from top to bottom and into the soil upon which the revetment rests.

It is a further object of the present invention to provide revetment which will reduce or eliminate erosion of soil substrate on which it is used.

Other objects and advantages of the present invention will become apparent during the course of the following summary and description.

SUMMARY OF THE INVENTION

The objects of the invention are achieved by a substantially rectangular grid having a flat bottom so that the bottom will make substantially continuous contact with the substrate soil or filter means constructed of natural materials or filter fabric or other flexible liquid-permeable membranes, if used. The grid has two optional vertical openings of substantially rectangular cross section through its middle portion. Such openings have two parallel sides and two opposed sides sloping inwardly from top to bottom.

The grid is provided with two U-shaped vertical channels on each of two long opposed sides. The remaining short opposed sides of the grid are provided with two-tier vertical channels which define vertical projections at each end of the short side of the grid. The lower portion of the sides of the grid are vertical and the upper portions slope inward.

According to one embodiment of the invention, the grids are positioned in abutting relationship with the short sides aligned into rows staggered one half the length of the short side, and the projections at each end of the short sides are received by a portion of the two-tier vertical channels in the short side of the blocks in the abutting, staggered row, thereby interlocking adjacent rows of grids.

In another embodiment of the invention, grids so positioned are interconnected into mats by connecting means comprising cables or rods passed through tunnels passing horizontally through the grids parallel to the longer sides thereof. Since such cables or rods pass through staggered grids, parallel cables or rods running in a single direction serve effectively to interconnect grids into an integral matrix of staggered rows of grids. The U-shaped vertical channels on the long sides of the grids cooperate with like vertical channels in abutting grids to create vertical openings of rectangular cross section throughout the mat.

In another embodiment of the invention utilizing an alternative connecting means, grids are interconnected into mats by inserting a short pin into a portion of each of two coaxial tunnels in adjacent grids as grids are positioned by hand.

Grids and mats may both be used with or without filter means constructed of natural materials or filter fabric or other flexible liquid-permeable membrane.

BRIEF DESCRIPTION OF THE DRAWINGS

The invention is now illustrated in detail by means of the drawings in which.

DESCRIPTION OF THE PREFERRED EMBODIMENTS

Figure 1:
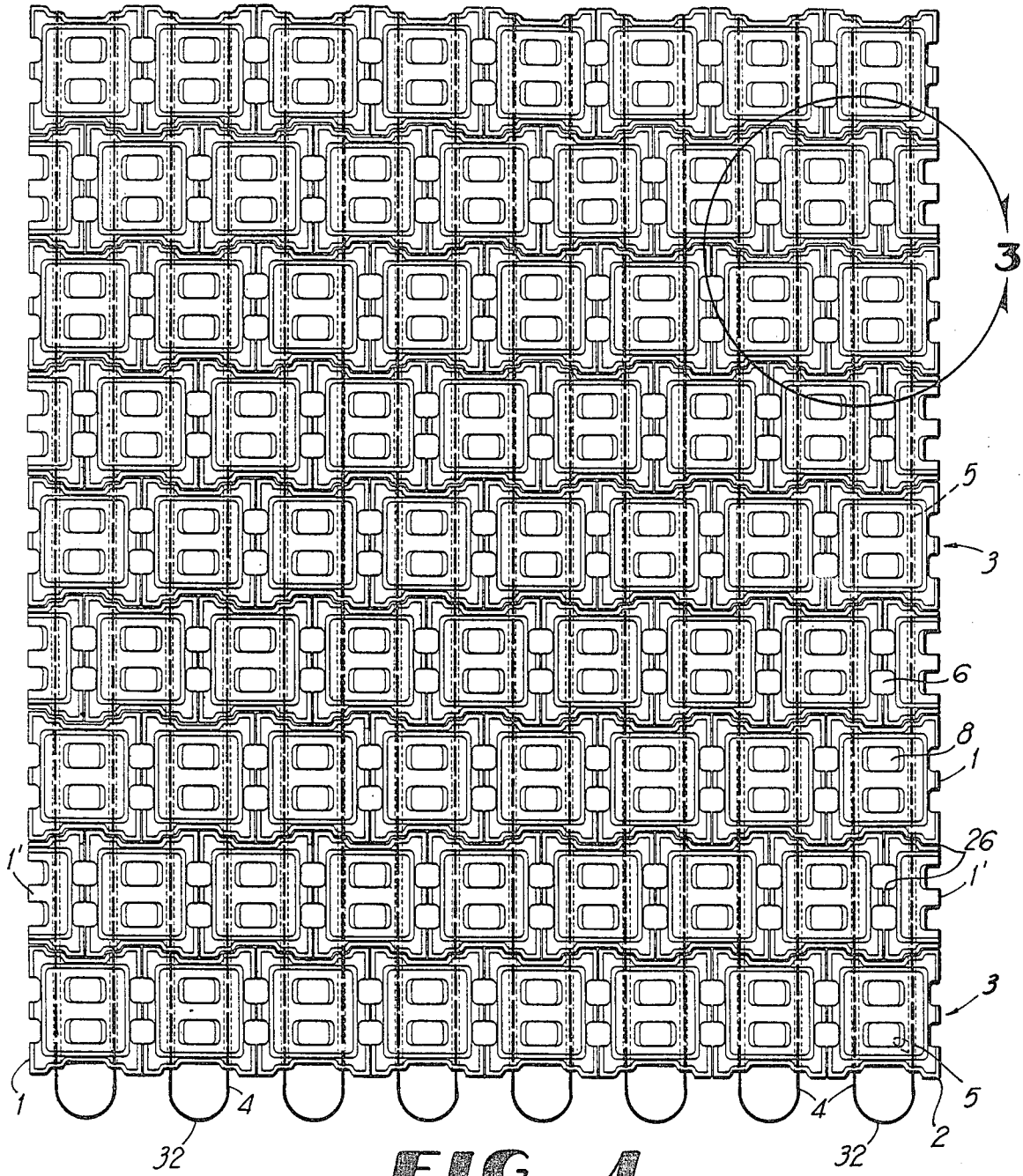
FIG. 1 is a top plan view of a portion of one embodiment of the revetment mat of the present invention.
Figure 4:
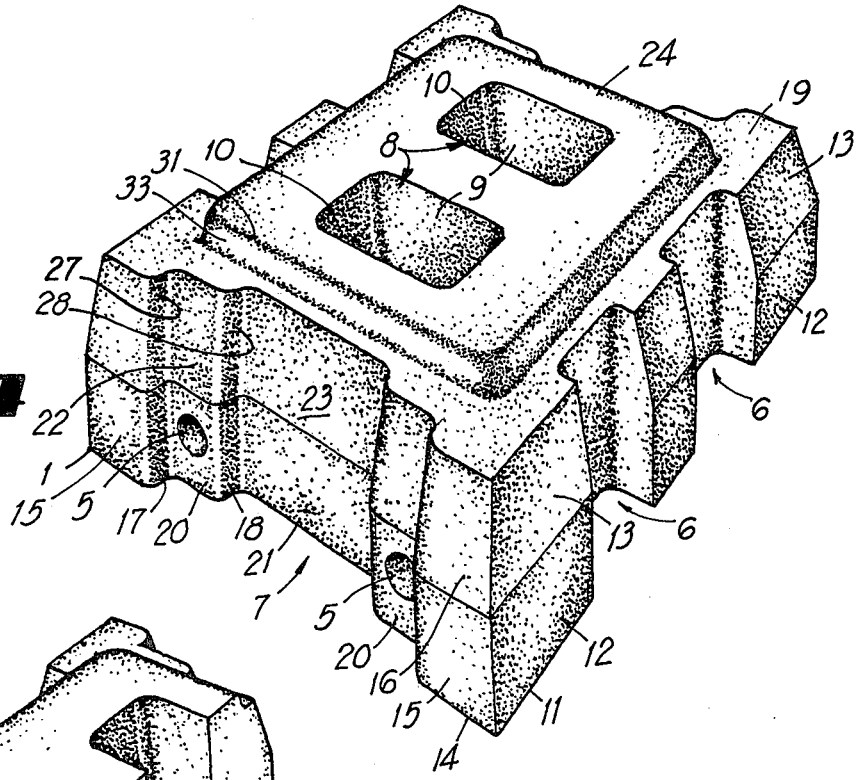
FIG. 4 is a perspective view of an individual grid embodied in FIG. 1.
Figure 5:
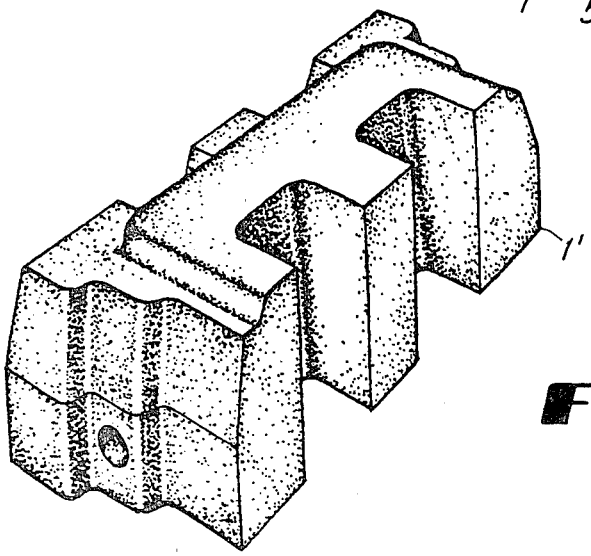
FIG. 5 is a perspective view of an individual half grid embodied in FIG. 1.
Figure 13:
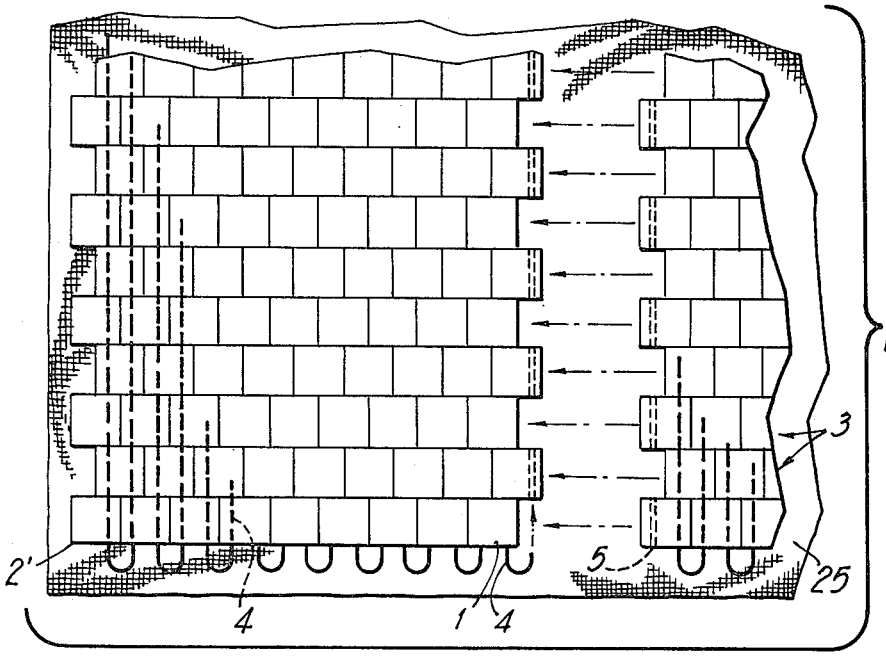
FIG. 13 is a top plan schematic diagram of an alternate embodiment of the mat showing a method of abutting two such mats.
Figure 14:
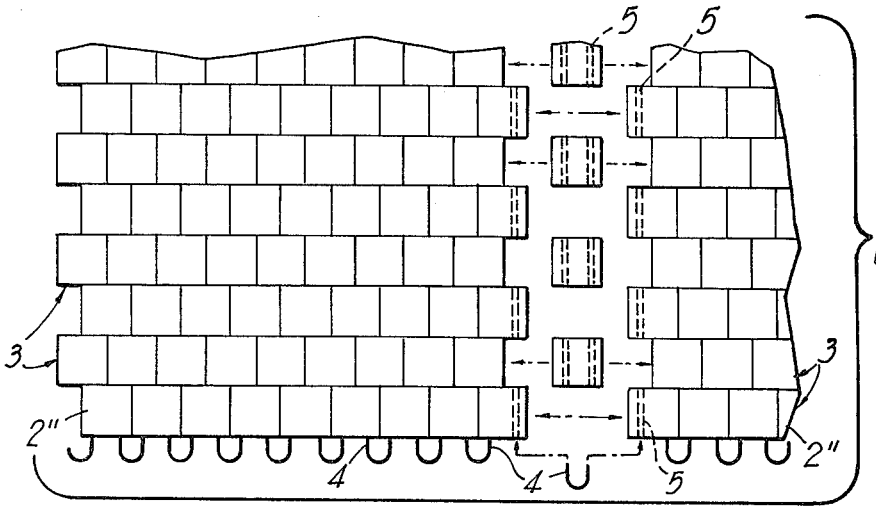
FIG. 14 is a top plan schematic diagram of another alternate embodiment showing a method of abutting two such mats.
Figure 15:
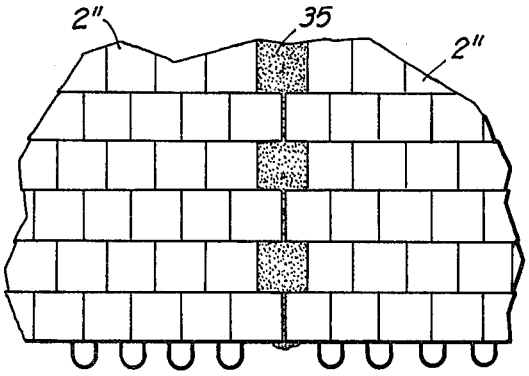
FIG. 15 is a top plan schematic diagram of the mats shown in FIG. 14 showing an alternative means of connecting such mats side by side.

In the figures, 1 is a precast grid, shown in perspective in FIG. 4, with additional views in FIGS. 6 through 9, and 1' in FIG. 5 is a half grid. FIG. 1 shows a mat 2 formed of staggered rows 3 of grids 1 and half grids 1' in abutting arrangement interconnected by cables 4 which pass through tunnels 5 in abutting grids 1 and half grids 1'. FIGS. 13, 14 and 15 show alternative mat configurations utilizing only grids 1 and no half grids 1'.

As is apparent in FIG. 1, half grids 1' are utilized solely at the ends of alternate rows 3 to fill the area which would otherwise be created at row ends by staggering of alternate row, thereby providing a mattress having substantially uniform sides. Such half grids 1' may be omitted in at least three configurations (shown in FIGS. 13, 14 and 15) which permit interconnection of mats into continuous revetment of any desired width.

Figure 2:
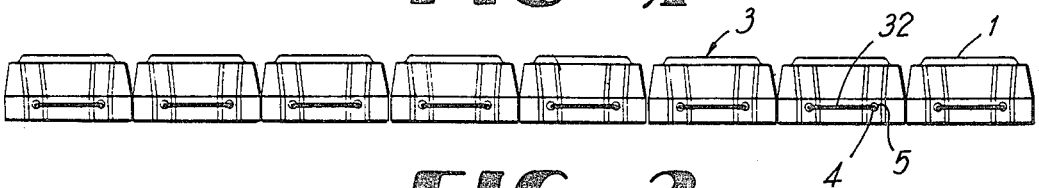
FIG. 2 is a an end elevation of the mat shown in FIG. 1.

FIG. 2 shows an elevation of an end row 3 of the mattress 2 as it would appear resting on a flat surface.

Figure 6:
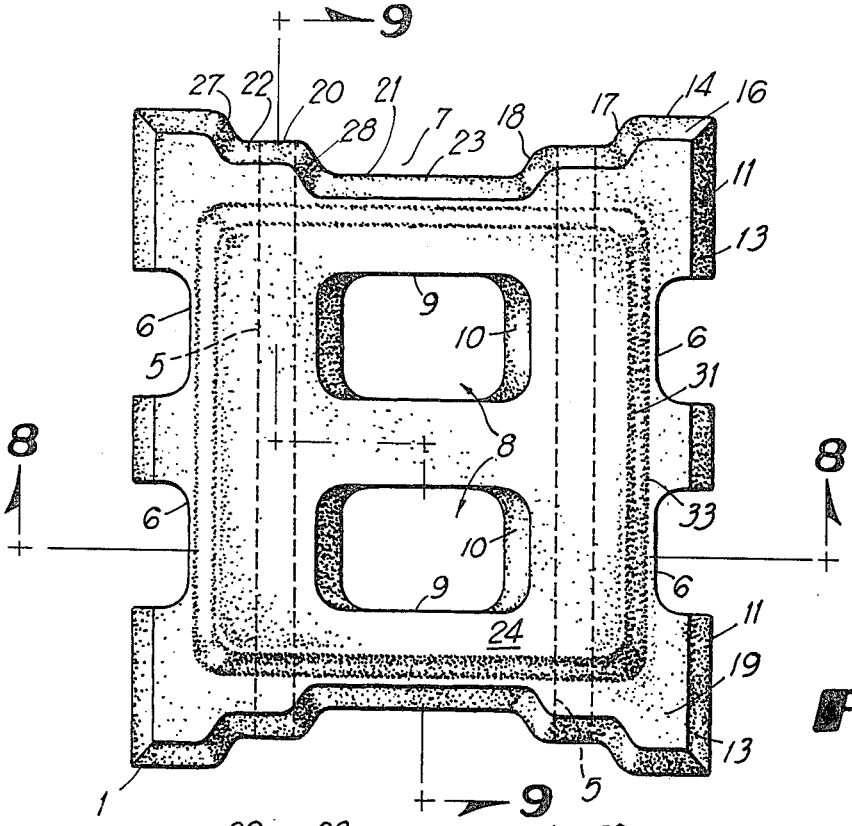
FIG. 6 is a top plan view of a grid.
Figure 7:
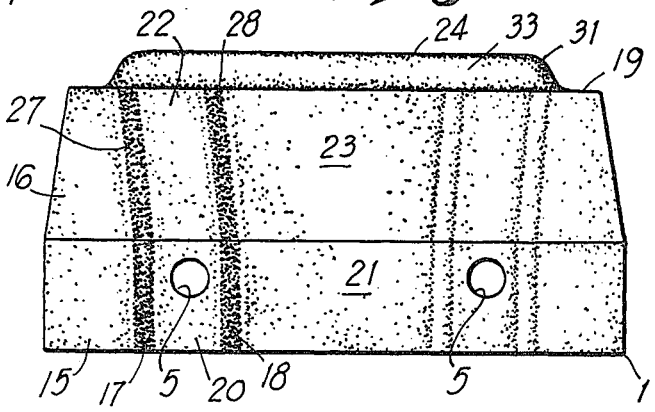
FIG. 7 is an end elevation of a grid.
Figure 8:
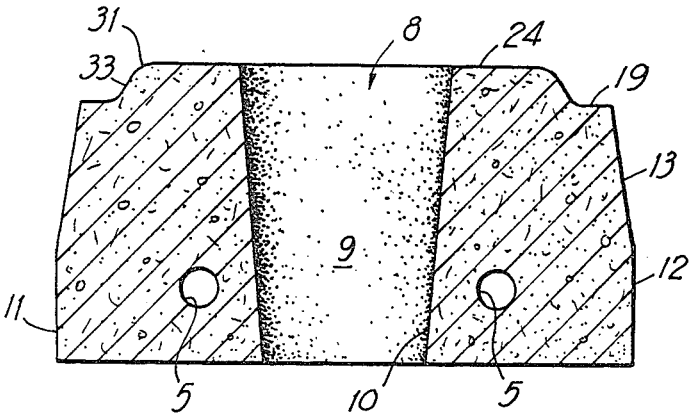
FIG. 8 is an elevational cross-section taken along lines 8—8 in FIG. 6.
Figure 9:
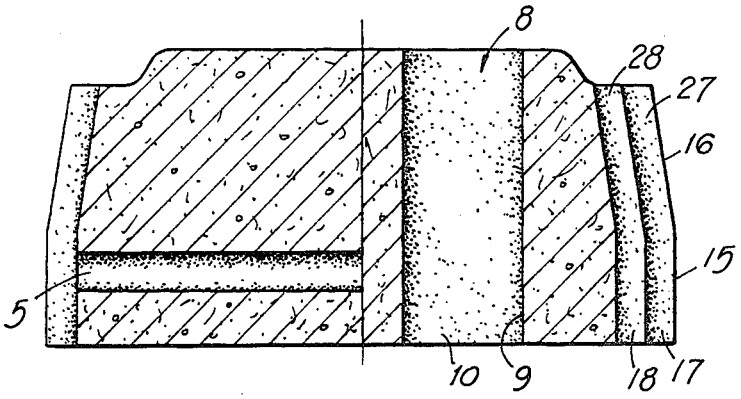
FIG. 9 is an elevational cross-section taken along lines 9—9 in FIG. 6.

Referring to FIGS. 4, 6 and 7, which show grid 1 in perspective, top plan and side elevation views, respectively, grid 1 is provided with two vertical openings 8 with continuously changing cross-section from top to bottom of grid 1. Such openings 8 have two opposed vertical sides 9, further illustrated in FIG. 9, and two opposed sloping sides 10, further illustrated in FIG. 8, which slope inwardly from top to bottom of the grid such that openings 8 have a substantially rectangular cross section. Openings 8 may alternatively be of non-rectangular cross sectional shape. Grid 1 is also provided with two opposed longer sides 11 which have a lower vertical surface 12 and an upper sloping surface 13 which slopes inwardly from the lower vertical surface 12 to a lower top surface 19. The longer sides 11 are also provided with two U-shaped vertical channels 6 which are spaced equal distances from the vertical center line of each longer side 11. Grid 1 has two opposed shorter sides 14 provided with lower vertical surfaces 15 and upper sloping surfaces 16. Each shorter side 14 is provided with a two-tier vertical channel 7 which is defined by lower vertical first and second tier surfaces 20 and 21, respectively, and upper first and second sloping surfaces 22 and 23, respectively, as well as first and second vertical incursion surfaces 17 and 18, respectively, and first and second sloping incursion surfaces 27 and 28, respectively. Vertical channel 7, which may alternatively be a single tier, is approximately as deep as the difference in length of the shorter side 14 and longer side 11 so that each grid 1 within a matrix of grids occupies a nominally square area. Grid 1 is further provided with a lower top surface 19 which is horizontal and extends around the periphery of the top of the grid and an upper top surface 24 which is slightly raised above lower top surface 19 and is substantially rectangular in outline, thus presenting a raised surface having a shape reminiscent of the numeral 8. There is a sloping transition surface 33 between lower and upper top surfaces 19 and 24, respectively, and a radius 31 at the intersection of transition surface 33 and upper top surface 24. Grid 1 is provided with two parallel tunnels 5, which extend horizontally through grid 1 and exit through each of the lower vertical first tier surfaces 20. Such tunnels 5 are of sufficient diameter to permit passage of cables or rods 4 through interconnected grids as shown in FIGS. 1, 13 and 14 but are of smaller diameter than the greatest diameter of pin 36 shown in FIGS. 16 and 17.

FIG. 5 shows half grid 1', which is identical to one-half of the full grid 1 if it were separated in two along a plane parallel to and equally distance from the longer sides 11 of grid 1.

Figure 16:
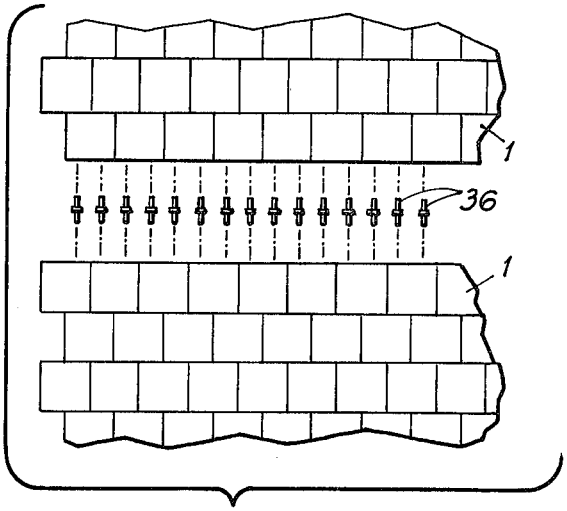
FIG. 16 is a top plan schematic diagram showing a method of individually placing grids and interconnecting pins.
Figure 17:
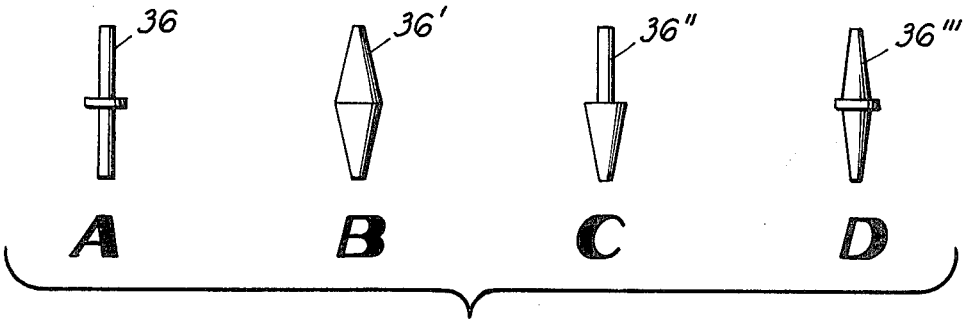
FIG. 17 is a top plan view of four alternative embodiments of the interconnecting pin shown in FIG. 16.

In use grids 1 and half grids 1' are located in place, either directly on soil substrate, filter means constructed of natural material such as sand, crushed stone or gravel or on top of filter fabric 25 (shown in FIGS. 12 and 13) or other flexible liquid-permeable membrane, in interlocking abutting relationship as shown in FIGS. 1, 13, 14, 15 and 16. As is hereinafter more fully described, grids may be interconnected, as, for instance, by use of cables or rods 4 shown in FIGS. 1, 13, 14 and 15, by use of pins 36 as shown in FIG. 16 or, alternatively, may be placed without utilization of interconnecting means.

Figure 12:
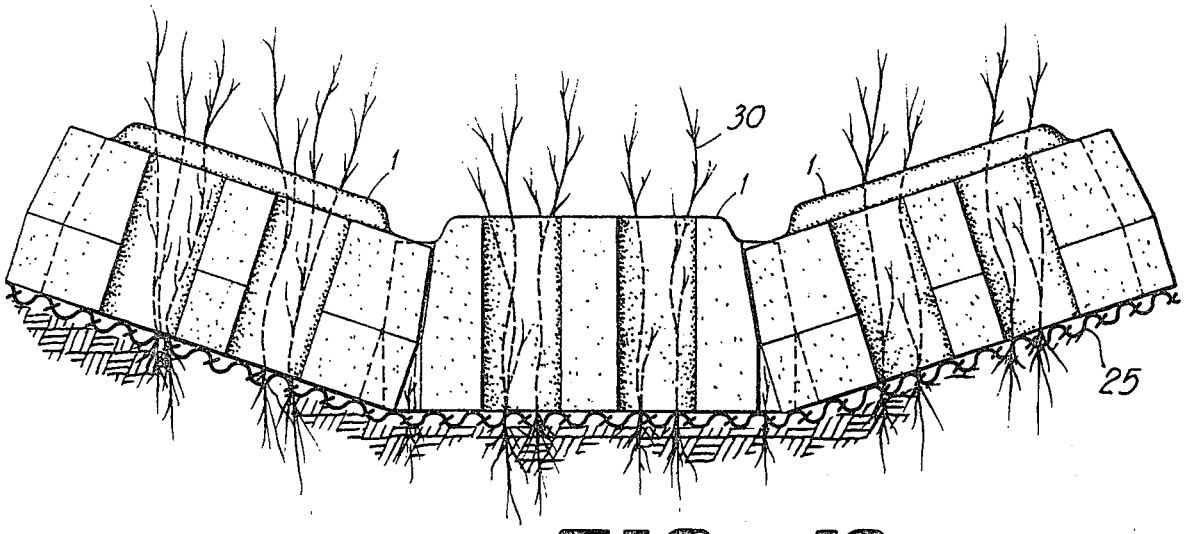
FIG. 12 is an environmental elevation similar to FIG. 10 of an alternate embodiment of the mat.

In use as revetment, features of grids 1 and half grids 1', if used, cooperate to achieve desired erosion control and other objects of the invention as follows:

Referring to FIG. 1, hydraulic relief for the revetment is provided by vertical openings 8 through grids 1, spaces 26 between grids and U-shaped channels 6, which, by opposing like channels in abutting grids in the mat 2, form additional vertical openings. Hydraulic pressure below the cellular concrete revetment system is free to pass upward through these open cells. Such relief prohibits the build-up of damaging hydrostatic pressures under the revetment and under topographic structures protected by the revetment and upon which it rests directly or with intermediate filter fabric 25 or other flexible liquid-permeable membrane as shown in FIGS. 12 and 13. Additionally, the vertical cells provided by vertical openings 8 and U-shaped channels 6 permit partial dissipation of energy in water waves which may buffet revetment in some applications. Such waves dissipate a portion of their energy under the revetment, and pressure tending to lift revetment during wave impact is thereby reduced.

These vertical cells also provide velocity dissipation of water flowing over the revetment. As flowing water passes over the cellular structure of the revetment, eddy currents will form within the vertical openings 8 and U-shaped channels 6. Formation of such eddy currents dissipates energy, thereby reducing the erosive velocity of the water sufficiently to prevent erosion of soil or other topographic structures underlying the revetment. The dimensional ratio of depth to width of vertical cellular openings in revetment is important to energy dissipation achieved. The preferred approximate ratio of vertical cell width to depth is less than 0.7 to 1.

Figure 11:
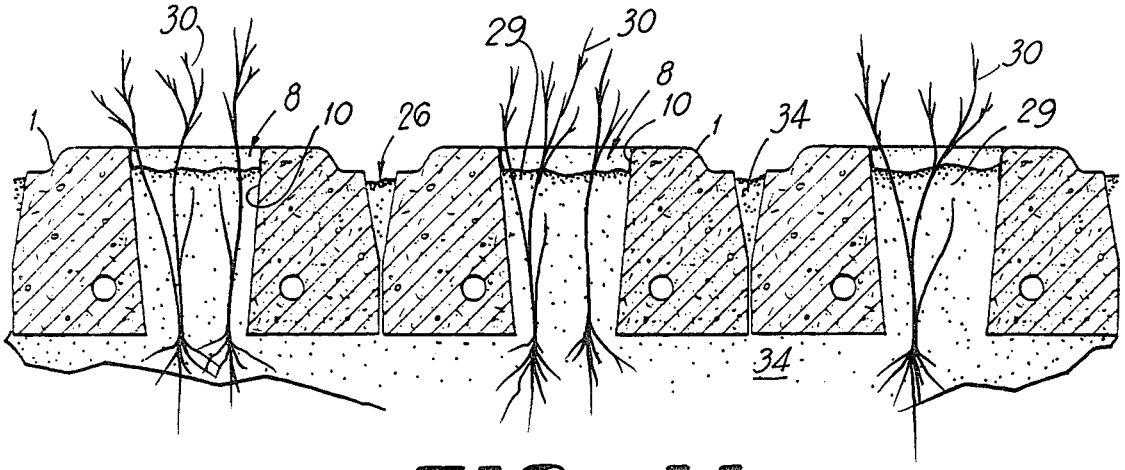
FIG. 11 is an environmental elevation taken transverse to the elevation of FIG. 10 showing a portion of a mat in communication with sand, gravel, soil or like filler material.

The vertical openings 8, U-shaped channels 6 and spaces 26 between grids also receive and retain soil and other particulate matter as is illustrated in FIG. 11. Such soil or particulate matter 34 unitizes adjacent grids 1 and half grids 1', if used, by providing binding between such grids. Stabilization of grids and mats is further enhanced by the sloping surfaces because backfill, soil or other particulate matter tends to hold grids and mats in place by the weight of such matter pressing down on sloping sides 10 and sloping surfaces 13, 16, 22 and 23 and because sloping sides 10 form soil, backfill, particulate matter or vegetative root systems into a plug or dovetail 29 which tends to lock grid members in place when the dovetail 29 connects with underlying soil or other substrate by packing or passage of vegetation 30 roots through the dovetail 29 into underlying soil structure. Eventually vegetation 30 may become sufficiently established within the backfilled soil to unitize the grids and firmly bind the revetment in place.

Figure 10:
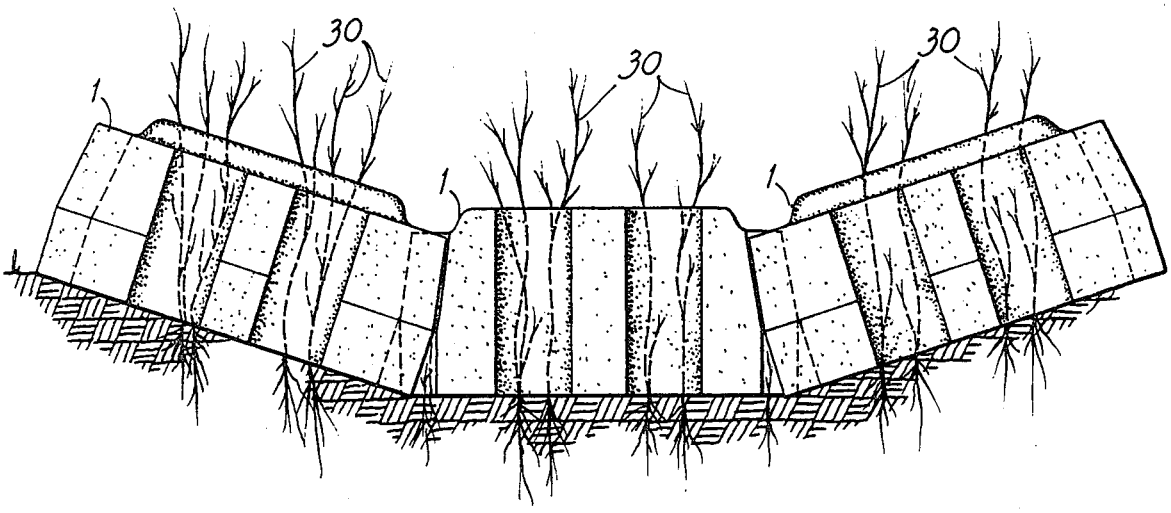
FIG. 10 is an environmental side elevation of a portion of a mat in communication with vegetation.

Referring to FIG. 4, lower vertical grid surfaces 12, 15, 17, 18, 20 and 21 are vertical to provide binding between abutting grids 1 and between abutting grids 1 and half grids 1', if used, in a matrix or mattress of grids. Such vertical surfaces between grids provide revetment which is more stable under flowing water and wave attack than revetment formed of grids with outer surfaces which slope along their entire height, because such vertical surfaces encourage buildup of binding soil and other particulate matter between abutting grids, thus creating frictional binding between abutting grids. Additionally, the lower vertical grid surfaces 12, 15, 17, 18, 20 and 21 inhibit dislocation of grids because the grids within a matrix or mattress pivot near their vertical mid-point rather than near the bottom of the grids, and any tendency for grids to pull out of a matrix or mattress is thereby avoided. Upper sloping surfaces 13, 16, 22, 23, 27 and 28 which slope from the lower vertical surfaces 12, 15, 20, 21, 17 and 18 respectively toward lower top surface 19 of grid 1 permit articulation of mat 2 and accommodation of topographic irregularities when grids 1 are interconnected into mats and when grids 1 are individually placed on the substrate, while maintaining substantial abutting contact among adjacent grids. Such accommodation of topographic irregularities is illustrated in FIG. 10, which also shows vegetation 30 growing up through openings 8 in grids 1. Utilization of an angle of slope of 9.5 degrees from vertical for such sloping surfaces 13, 16, 22, 23, 27 and 28 permits articulation of the mat 2 into arcs having a radius of approximately three (3) feet (0.9 meters) when abutting grids 1 have substantially contiguous sloping surfaces 16, 22 and 23, or, alternatively, 13, 27 and 28 and such grids 1 have a shorter side 14 of approximately one (1) foot (0.3 meters) in length.

Figure 3:
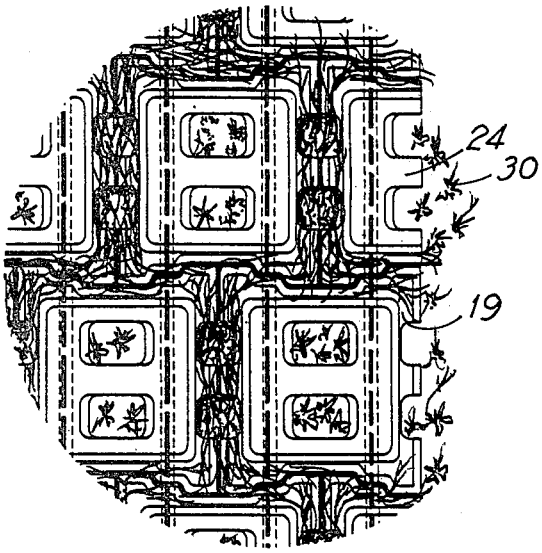
FIG. 3 is an enlarged inset plan view taken from inset circle 3 shown in FIG. 1.

Upper top surface 24 of grid 1 provides a flat and safe pedestrianable surface because the human foot will normally rest squarely on such surface of one grid or bridge upper top surfaces 24 of adjacent abutting grids. Lower top surface 19 forms a lower vegetation platform, as shown in FIG. 3, upon which vegetation 30 having roots extending between adjacent grids and/or through U-shaped channels 6 can initially spread. Such vegetation 30 supported by lower top surface 19 will initially provide partial cover of grids and mats and will eventually extend over upper top surface 24, along with vegetation with roots extending through vertical openings 8, to provide a complete cover of grid systems and mats. Such vegetation contributes ecological and aesthetic value to areas protected by revetment of the present invention and provides stability to such revetment.

Additional features of the present invention are illustrated in FIGS. 4 and 6 through 9. The relatively flat upper top surface 24 of grid 1 and half grid 1' exhibits a low Manning coefficient (a measure of resistance to passage of fluids over a surface) to permit maximum flow rate of water flowing over revetment of the present invention. An even lower Manning coefficient can be achieved by omission of the optional vertical openings 8. Omission of optional vertical openings 8 also reduces the surface area to which ice can bond in environments where ice forms. Regardless of whether vertical openings 8 are utilized, the grid of the present invention avoids raised castellations as are employed on the top surfaces of some known revetment, which castellations create more turbulent water flow and thus produce a higher Manning coefficient. The lower Manning coefficient of the present invention permits a deeper and more narrow channel to accommodate a given hydraulic flow.

Castellations in the design of known cellular concrete revetment members also contribute to a tendency for compression heads in the equipment for manufacturing such members to accumulate concrete in concave areas because of the difficulty of cleaning the irregular pattern of a compression head which forms such castellations. Such build-up of concrete in compression heads creates voids in concrete members manufactured in the heads. Accordingly, the smoother upper top surface 24 of the grid 1 and half grid 1' of present invention eliminates such build up during manufacture of the grid of concrete, and consequent creation of voids during manufacture, because cleaning of the compession head is simpler and may be performed more rapidly. Additionally, a relatively smooth upper top surface 24 assures better compression during manufacture so that the concrete is better consolidated, which results in less grid damage from vehicle traffic, flowing water, ice floes, freeze/thaw cycles and the like.

Ease of manufacture is further enhanced by sloping transition surface 33 between lower and upper top surfaces 19 and 24, respectively, and the radius 31 at the intersection of transition surface 33 and upper top surface 24 which permits stripping of the grid from its mold and mold cleaning during production without excessive build-up of material in the mold where such transition surface 33 is formed. The absence of a sharp corner at radius 31 furthermore diminishes the tendency for stems of vegetation 30 to be cut when pressed against upper top surface 24 by pedestrian or vehicular traffic.

Grids can be individually placed without interconnecting cables or rods 4, preassembled on cables or rods 4, individually placed with later addition of cables or rods 4 or individually placed and interconnected with pins 36 as is illustrated in FIG. 16.

Grids 1 and half grids 1', if used, are interconnected into a mat 2, shown in FIG. 1, mats 2', shown in FIG. 13, or mats 2" shown in FIGS. 14 and 15, by means of parallel cables or rods 4 which pass through cable tunnels 5 in each of the grids. Since the cables 4 pass through grids in staggered rows 3, parallel cables running in a single direction effectively interconnect grids into an integral matrix of staggered rows 3 of grids 1 and half grids 1' without any need for cables running transversely through the grid system to interlock adjacent lines of grids. An articulatable mat is thus unitized in both directions with cables running in a single direction, which reduces the amount of cable required to produce mats. This feature of the present invention also eliminates the need for providing cable tunnels transverse to tunnels 5 in grids 1 and half grids 1'. Such transverse cable tunnels are difficult and expensive to provide during production of precast concrete grids. Use of transverse cable tunnels also weakens a grid provided with such tunnels by creating additional rupture lines and effectively sectionalizing the grid.

Figure 18A:
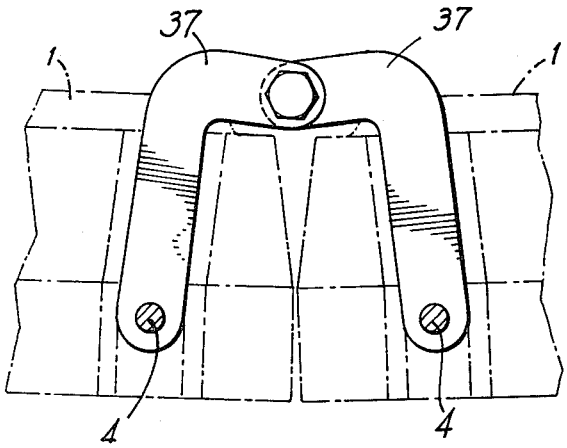
FIGS. 18A and 18B are elevational cross sections of a portion of two side-by-side mats showing two alternative means of connecting the mats.
Figure 18B:
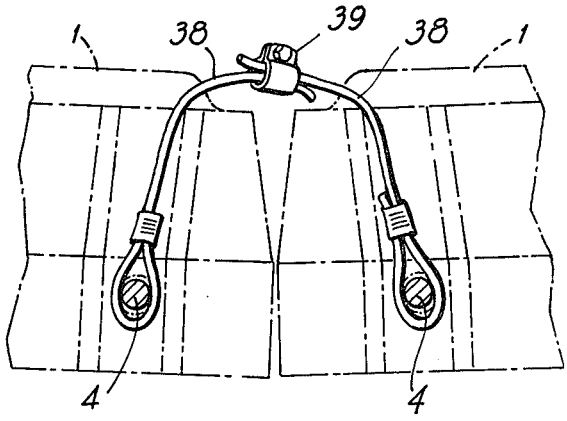

Mats 2 placed side by side may be connected by means of short straps, cables or rods running from the outermost cable or rod of a first mat to the outermost cable or rod of a second mat. Two illustrative embodiments of this connecting means are shown in FIGS. 18A and 18B. Mats 2 may be assembled with short straps, cables, rods or loops attached to the outermost cable or rod on each side of each mat 2. Such mats 2 may be connected side by side by connecting or binding each projecting strap, cable, rod or loop to a like connecting means projecting from the adjacent mat 2. FIG. 18A shows such a connection by means of straps 37. FIG. 18B illustrates such a connection by wire stubs 38 which are connected by connecting means 39. Connecting means 39 may be any suitable clamp or other conventional binding means.

Half grids 1' may be omitted to permit side-by-side interconnection of mats into continuous revetment of any desired width. Such interconnection may be accomplished with mats constructed solely of grids 1 in either of two embodiments.

In a first alternative embodiment, illustrated in FIG. 13, mats 2' are produced with each of rows 3 having the same number of grids 1, such that one-half of a grid 1 in abutting rows 3 projects on alternate sides of the mat 2'. Production in this form will permit side by side interconnection of mats with like numbers of rows 3 such that the mats have co-linear top and bottom rows of grids.

Mats 2' produced in this first alternative embodiment are interconnected in the manner illustrated in FIG. 13. Mats 2' are laid side by side such that one-half of each projecting grid 1 at row 3 ends of a first mat is received in the space between projecting grids 1 at row 3 ends on a second mat, thereby producing continuous rows of interconnecting grids within the two mats 2' so placed. Following such placement a single cable or rod 4 may be passed through the coaxial tunnels 5 of grids 1 previously connected to one of the two mats, thereby positively interconnecting the first and second mats into a single mattress.

In a second alternative embodiment or configuration, illustrated in FIG. 14, mats 2" are produced with alternate rows 3 having one fewer grid 1 than each row 3 adjacent to such alternate rows, such that one-half of a grid 1 projects on both ends of alternate rows. This configuration also permits side-by-side interconnection with co-linear top and bottom mat rows.

Mats 2" produced in the second alternative configuration may be interconnected, as is illustrated in FIG. 14, by placing a first mat 2" in side by side relationship with a second mat 2" such that projecting grids 1 at row 3 ends of the first mat are in side by side abutting relationship with projecting grids 1 at row 3 ends of the second mat, thereby defining full-grid openings in alternate rows. A loose grid 1 may then be inserted in each such opening, and cables or rods 4 may be passed through tunnels 5 of such loose grids 1 and through abutting grids having tunnels 5 coaxial with such loose grids. Interconnection of mats 2" placed in side by side abutting relationship may alternatively be accomplished as illustrated in FIG. 15 by pouring concrete 35 into the full-grid openings in alternate rows and permitting such concrete 35 to cure, thereby bonding row end grids 1 of one mat 2" to abutting row end grids 1 of another mat 2".

In addition to permitting interlocking of grids into a mat by use of pins or a single parallel series of cables or rods, the interlocking feature of the present invention enables a mat to maintain its integrity even if the cables or rods 4 or pins 36 deteriorate or otherwise cease to interconnect grids. In use, revetment of the present invention is placed with rows 3 parallel to the direction of the flow of water, and such flowing water cannot remove a single grid 1 or half grid 1' on the downstream side of the revetment because of interlocking with adjacent grids. Thus, the mat 2 or revetment of individually placed grids cannot fail progressively from the downstream side.

Grids 1 and half grids 1', if used, within mat 2 are not affixed to cables or rods 4 and are free to move along cables or rods 4 and thereby adjacent themselves in place while permitting differential spreading of the grids within the tolerances permitted by the interlocking of the grids.

The cables or rods 4 may be looped where they exit the mat 2 and bound into loops 32, as is shown on FIG. 1, by conventional clamps or other means, not shown. Such loops 32 permit attachment to the mat 2 for lifting and placement by a conventional strongback. Loops 32 may later be cut to permit attachment, by clamps or other means, of the cable 4 ends projecting from one mat 2 to the cable 4 ends projecting from a second mat 2 placed end-to-end with the first. When steep slopes are encountered, anchors may be set and cables or rods 4 attached to such anchors to prevent sliding or displacement or the revetment.

Although the FIGS. 1, 13 and 14 show a mat having a greater dimension along the length of connecting means 4, mats may be produced in any convenient form, including configurations wherein the greater dimension is that perpendicular to connecting means 4 and ones in which various rows 3 have different numbers of grids 1 such that the mat 2 is not rectilinear in outline.

Interconnection of grids 1 by means of pins 36 during individual placement of grids, as illustrated in FIG. 16, is accomplished by positioning a pin 36 in coaxial tunnels 5 of abutting grids 1 as such grids are individually placed by hand or other means. Pins 36 may be of any shape and dimensions suitable to limit relative movement between abutting grids 1 while permitting articulation of the mattress of grids sufficient to accommodate topographic irregularities. Illustrative alternative embodiments of pin 36 are shown as pins 36, 36' and 36" and 36'" in FIG. 17. Pins 36 may be made of any suitable shear resistant, resilient material, including ceramics, metals, plastics and hard rubbers.

Grid 1 and half grid 1' may be produced by conventional precast concrete producing equipment utilizing a conventional vibration and compression method. The tunnels 5 are formed by inserting two hydraulically actuated rods into the cellular concrete mold during production of the grid. After the grid has gone through its casting and vibration cycle, the hydraulically actuated rods are withdrawn, leaving two hollow tunnels within the grid. While grids of the present invention will typically be produced of conventional concrete, comprising primarily portland cement, aggregate and Pozzolan material, any suitable moldable or castable composition may be employed within the present invention, including other cementatious compositions, plastics and decomposable compositions such as processed garbage.

Although the present invention is described and illustrated above with detailed reference to the preferred embodiment, the invention is not limited to the details of such embodiment but is capable of numerous modifications within the scope of the appended claims.

I claim:

1. A block for use as revetment, comprising a rectangular precast grid, said grid having:
- (a) two opposed longer sides, each of said longer sides having:
  - (i) a lower vertical surface;
  - (ii) an upper sloping surface which slopes inward from the longer side lower vertical surface; and
  - (iii) at least one vertical channel;
- (b) two opposed shorter sides, each of said shorter sides having:
  - (i) a lower vertical surface;
  - (ii) an upper sloping surface which slopes inward from the shorter side lower vertical surface; and
  - (iii) a vertical channel of depth approximately equivalent to the difference in length between the longer and shorter sides and width sufficient to receive projecting portions of the shorter sides of two like grids in staggered abutting relationship with said grid, said vertical channel having:
    - (x) two tiers;
    - (y) lower vertical first and second tier surfaces; and
    - (z) upper sloping first and second tier surfaces;
- (c) a horizontal lower top surface extending around the periphery of the grid;
- (d) a horizontal upper top surface raised slightly above the lower top surface; and
- (e) a plurality of through tunnels extending horizontally parallel to the longer sides.

2. A block for use as revetment, according to claim 1, wherein the grid is concrete.

3. A block for use as revetment, comprising a rectangular precast concrete grid, said grid having:
- (a) two opposed longer sides, each of said longer sides having:
  - (i) a lower vertical surface;
  - (ii) an upper sloping surface which slopes inward from the longer side lower vertical surface; and
  - (iii) at least one vertical channel;
- (b) two opposed shorter sides, each of said shorter sides having:
  - (i) a lower vertical surface;
  - (ii) an upper sloping surface which slopes inward from the shorter side lower vertical surface; and
  - (iii) a vertical channel of depth approximately equivalent to the difference in length between the longer and shorter sides and width sufficient to receive projecting portions of the shorter sides of two like grids in staggered abutting relationship with said grid, said vertical channel having:
    - (x) two tiers;

(y) lower vertical first and second tier surfaces; and (z) upper sloping first and second tier surfaces;

(c) a horizontal lower top surface extending around the periphery of the grid;

(d) a horizontal upper top surface raised slightly above the lower top surface;

(e) at least one vertical opening of continuously changing rectangular cross section such that the upper end of the opening is larger than the lower end of the opening; and (f) a plurality of through tunnels extending horizontally parallel to the longer sides.

4. A flexible revetment mat comprising:

(A) a plurality of rectangular precast grids in substantially abutting relationship of staggered interlocking rows, each of said grids having:

(a) two opposed longer sides, each of said longer sides having:

(i) a lower vertical surface;

(ii) an upper sloping surface which slopes inward from the longer side lower vertical surface; and (iii) a vertical channel;

(b) two opposed shorter sides, each of said shorter sides having:

(i) a lower vertical surface;

(ii) an upper sloping surface which slopes inward from the shorter side lower vertical surface; and (iii) a vertical channel of depth approximately equivalent to the difference in length between the longer and shorter sides and width sufficient to receive projecting portions of the shorter sides of two like grids in staggered abutting relationship with said grid, said vertical channel having:

(x) two tiers;

(y) lower vertical first and second tier surfaces; and (z) upper sloping first and second tier surfaces;

(c) a horizontal lower top surface extending around the periphery of the grid;

(d) a horizontal upper top surface raised slightly above the lower top surface;

(e) a plurality of through tunnels extending horizontally parallel to the longer sides; and (B) a plurality of connecting means extending into the tunnels and interconnecting the grids.

5. A flexible revetment mat according to claim 4, wherein said staggered interlocking rows each contain an equal number of grids.

6. A flexible revetment mat according to claim 4, wherein alternate staggered interlocking long rows contain one grid more than is contained in each short row abutting any such alternate long row.

7. A flexible revetment mat according to claim 6, wherein a half grid substantially identical to one-half of one of the grids separated in two along a plane parallel to and equally distant from the first sides thereof is contained at each end of each of the short rows.

8. A flexible revetment mat according to claim 4, wherein each of said grids is concrete.

9. A flexible concrete revetment mat comprising:

(A) a plurality of rectangular precast concrete grids in substantially abutting relationship of staggered interlocking rows, each of said grids having:

(a) two opposed longer sides, each of said longer sides having:

(i) a lower vertical surface;

(ii) an upper sloping surface which slopes inward from the longer side lower vertical surface; and (iii) a vertical channel;

(b) two opposed shorter sides, each of said shorter sides having:

(i) a lower vertical surface;

(ii) an upper sloping surface which slopes inward from the shorter side lower vertical surface; and (iii) a vertical channel of depth approximately equivalent to the difference in length between the longer and shorter sides and width sufficient to receive projecting portions of the shorter sides of two like grids in staggered abutting relationship with said grid, said vertical channel having:

(x) two tiers;

(y) lower vertical first and second tier surfaces; and (z) upper sloping first and second tier surfaces;

(c) a horizontal lower top surface extending around the periphery of the grid;

(d) a horizontal upper top surface raised slightly above the lower top surface;

(e) at least one vertical opening of continuously changing rectangular cross section such that the upper end of the opening is larger than the lower end of the opening; and (f) a plurality of through tunnels extending horizontally parallel to the longer sides; and (B) a plurality of connecting means extending into the tunnels and interconnecting the grids.

10. A flexible concrete revetment mat according to claim 9, wherein said staggered interlocking rows each contain an equal number of grids.

11. A flexible concrete revetment mat according to claim 9, wherein alternate staggered interlocking long rows contain one grid more than is contained in each short row abutting any such alternate long row.

12. A flexible concrete revetment mat according to claim 11, wherein half grids substantially identical to one-half of one of the grids divided along a plane parallel to and equally distant from the longer sides of the grid is contained at each end of each of the short rows.

13. A flexible revetment mat according to any one of claim 4, claim 8, claim 9, claim 10, claim 11, or claim 12, further comprising filter fabric under said mat.

14. A flexible revetment mat according to claim 4 or 9, further comprising means for interconnecting the mat in side by side abutting relationship with at least one like mat.

* * * * *